US010490903B2

(12) United States Patent
Foo

(10) Patent No.: US 10,490,903 B2
(45) Date of Patent: Nov. 26, 2019

(54) LIQUID-CRYSTAL RECONFIGURABLE METASURFACE REFLECTOR ANTENNA

(71) Applicant: Senglee Foo, Ottawa (CA)

(72) Inventor: Senglee Foo, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 112 days.

(21) Appl. No.: 15/630,396

(22) Filed: Jun. 22, 2017

(65) Prior Publication Data

US 2018/0109002 A1 Apr. 19, 2018

Related U.S. Application Data

(60) Provisional application No. 62/409,710, filed on Oct. 18, 2016.

(51) Int. Cl.

| | |
|---|---|
| ***H01Q 15/14*** | (2006.01) |
| ***H01Q 21/29*** | (2006.01) |
| ***H01Q 3/46*** | (2006.01) |
| ***H01Q 21/06*** | (2006.01) |

(52) U.S. Cl.

CPC ..... *H01Q 15/148* (2013.01); *H01Q 3/46* (2013.01); *H01Q 21/065* (2013.01); *H01Q 21/293* (2013.01)

(58) Field of Classification Search

CPC ..... H01Q 15/148; H01Q 21/293; H01Q 3/46; H01Q 21/065; H01Q 21/29; H01Q 15/14

USPC ..... 343/835

See application file for complete search history.

(56) References Cited

U.S. PATENT DOCUMENTS

| | | | | |
|---|---|---|---|---|
| 6,552,696 | B1 * | 4/2003 | Sievenpiper | H01Q 3/44 343/700 MS |
| 2015/0214615 | A1 * | 7/2015 | Patel | H01Q 3/36 342/372 |
| 2015/0276928 | A1 | 10/2015 | Bowers et al. | |
| 2016/0036111 | A1 * | 2/2016 | Gregoire | H01Q 13/20 342/371 |

FOREIGN PATENT DOCUMENTS

| | | | |
|---|---|---|---|
| CA | 2976830 | A1 | 9/2016 |
| WO | 2012080532 | A1 | 6/2012 |
| WO | 2016130383 | A1 | 8/2016 |

OTHER PUBLICATIONS

D.F. Sievenpiper, J.H. Schaffner, H.J. Song, R.Y. Loo, and G. Tangonan, "Two-Dimensional Beam Steering Using an Electrically Tunable Impedance Surface," IEEE Transactions on Antennas and Propagation, vol. 51, No. 10, pp. 2713-2722, Oct. 2003.

Couch A et al: "A phase-tunable, liquid crystal-based metasurface", 10th INTL IEEE Congress on Advanced Electromagnetic Materials in Microwaves and Optics (Metamaterials), Sep. 19, 2016, pp. 94-96, XP033009916.

Ghaffer I. Kiani et al. Single-Layer Bandpass Active Frequency Selective Surface, Microwave and Optical Technology Letters, 50, (8), Aug. 2008, pp. 2149-2151. XP002582502.

* cited by examiner

*Primary Examiner* — Hai V Tran

(57) ABSTRACT

A reflector antenna that includes a feed for generating a radio frequency (RF) signal, and a metasurface reflector for reflecting the RF signal originating from the feed. The metasurface reflector includes an array of cells each having a volume of liquid crystal with a controllable dielectric value enabling a reflection phase of the cells to be selectively tuned to effect beam steering of the reflected RF signal.

19 Claims, 9 Drawing Sheets

| | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 43 | 43 | 66 | 79 | 79 | 66 | 43 | 43 | 0 | 0 | 0 | 0 | 0 | 0 |
| 0 | 0 | 0 | 0 | 0 | 49 | 88 | 121 | 144 | 159 | 159 | 144 | 121 | 88 | 49 | 0 | 0 | 0 | 0 | 0 |
| 0 | 0 | 0 | 0 | 66 | 116 | 154 | 184 | 215 | 235 | 235 | 215 | 184 | 154 | 116 | 66 | 0 | 0 | 0 | 0 |
| 0 | 0 | 0 | 66 | 126 | 175 | 214 | 253 | 286 | 305 | 305 | 286 | 253 | 214 | 175 | 126 | 66 | 0 | 0 | 0 |
| 0 | 0 | 49 | 116 | 175 | 225 | 261 | 322 | 362 | 19 | 19 | 362 | 322 | 261 | 225 | 175 | 116 | 49 | 0 | 0 |
| 0 | 43 | 88 | 154 | 214 | 261 | 308 | 18 | 47 | 66 | 66 | 47 | 18 | 308 | 261 | 214 | 154 | 88 | 43 | 0 |
| 0 | 43 | 121 | 184 | 253 | 322 | 18 | 59 | 92 | 112 | 112 | 92 | 59 | 18 | 322 | 253 | 184 | 121 | 43 | 0 |
| 0 | 66 | 144 | 215 | 286 | 362 | 47 | 92 | 126 | 147 | 147 | 126 | 92 | 47 | 362 | 286 | 215 | 144 | 66 | 0 |
| 0 | 79 | 159 | 235 | 305 | 19 | 66 | 112 | 147 | 168 | 168 | 147 | 112 | 66 | 19 | 305 | 235 | 159 | 79 | 0 |
| 0 | 79 | 159 | 235 | 305 | 19 | 66 | 112 | 147 | 168 | 168 | 147 | 112 | 66 | 19 | 305 | 235 | 159 | 79 | 0 |
| 0 | 66 | 144 | 215 | 286 | 362 | 47 | 92 | 126 | 147 | 147 | 126 | 92 | 47 | 362 | 286 | 215 | 144 | 66 | 0 |
| 0 | 43 | 121 | 184 | 253 | 322 | 18 | 59 | 92 | 112 | 112 | 92 | 59 | 18 | 322 | 253 | 184 | 121 | 43 | 0 |
| 0 | 43 | 88 | 154 | 214 | 261 | 308 | 18 | 47 | 66 | 66 | 47 | 18 | 308 | 261 | 214 | 154 | 88 | 43 | 0 |
| 0 | 0 | 49 | 116 | 175 | 225 | 261 | 322 | 362 | 19 | 19 | 362 | 322 | 261 | 225 | 175 | 116 | 49 | 0 | 0 |
| 0 | 0 | 0 | 66 | 126 | 175 | 214 | 253 | 286 | 305 | 305 | 286 | 253 | 214 | 175 | 126 | 66 | 0 | 0 | 0 |
| 0 | 0 | 0 | 0 | 66 | 116 | 154 | 184 | 215 | 235 | 235 | 215 | 184 | 154 | 116 | 66 | 0 | 0 | 0 | 0 |
| 0 | 0 | 0 | 0 | 0 | 49 | 88 | 121 | 144 | 159 | 159 | 144 | 121 | 88 | 49 | 0 | 0 | 0 | 0 | 0 |
| 0 | 0 | 0 | 0 | 0 | 0 | 43 | 43 | 66 | 79 | 79 | 66 | 43 | 43 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

FIG. 10

| | | | | | | | | | | | | | | | | | | | |
|---|---|---|---|---|---|---|---|---|---|---|---|---|---|---|---|---|---|---|---|
| 0 | 0 | 28 | 52 | 155 | 114 | 316 | 236 | 359 | 272 | 272 | 359 | 236 | 316 | 114 | 155 | 52 | 28 | 0 | 0 |
| 0 | 4 | 79 | 127 | 178 | 223 | 261 | 292 | 344 | 397 | 397 | 344 | 292 | 261 | 223 | 178 | 127 | 79 | 4 | 0 |
| 0 | 42 | 107 | 167 | 221 | 268 | 308 | 348 | 5 | 29 | 30 | 5 | 348 | 308 | 268 | 221 | 167 | 107 | 42 | 0 |
| 0 | 71 | 139 | 202 | 258 | 305 | 352 | 37 | 62 | 89 | 88 | 62 | 37 | 352 | 305 | 258 | 202 | 139 | 71 | 0 |
| 21 | 95 | 164 | 231 | 291 | 344 | 30 | 67 | 94 | 111 | 111 | 94 | 67 | 30 | 344 | 291 | 231 | 164 | 95 | 21 |
| 36 | 113 | 186 | 254 | 319 | 13 | 61 | 106 | 130 | 147 | 147 | 130 | 106 | 61 | 13 | 319 | 254 | 186 | 113 | 36 |
| 44 | 123 | 199 | 269 | 335 | 33 | 84 | 126 | 157 | 176 | 176 | 157 | 126 | 84 | 33 | 335 | 269 | 199 | 123 | 44 |
| 45 | 128 | 203 | 276 | 344 | 45 | 98 | 142 | 175 | 195 | 195 | 175 | 142 | 98 | 45 | 344 | 276 | 203 | 128 | 45 |
| 38 | 125 | 200 | 274 | 344 | 47 | 102 | 147 | 181 | 203 | 203 | 181 | 147 | 102 | 47 | 344 | 274 | 200 | 125 | 38 |
| 23 | 107 | 187 | 263 | 333 | 37 | 93 | 146 | 175 | 197 | 197 | 175 | 146 | 93 | 37 | 333 | 263 | 187 | 107 | 23 |
| 0 | 51 | 133 | 207 | 278 | 342 | 35 | 85 | 120 | 142 | 142 | 120 | 85 | 35 | 342 | 278 | 207 | 133 | 51 | 0 |
| 0 | 19 | 89 | 154 | 210 | 256 | 301 | 17 | 71 | 92 | 92 | 71 | 17 | 301 | 256 | 210 | 154 | 89 | 19 | 0 |
| 0 | 0 | 38 | 111 | 178 | 240 | 293 | 337 | 3 | 26 | 30 | 3 | 337 | 293 | 240 | 178 | 111 | 38 | 0 | 0 |
| 0 | 0 | 0 | 45 | 114 | 173 | 224 | 265 | 306 | 316 | 315 | 306 | 265 | 224 | 173 | 114 | 45 | 0 | 0 | 0 |
| 0 | 0 | 0 | 0 | 41 | 97 | 145 | 185 | 214 | 232 | 232 | 214 | 185 | 145 | 97 | 41 | 0 | 0 | 0 | 0 |
| 0 | 0 | 0 | 0 | 0 | 13 | 59 | 96 | 123 | 140 | 140 | 123 | 96 | 59 | 13 | 0 | 0 | 0 | 0 | 0 |
| 0 | 0 | 0 | 0 | 0 | 0 | 0 | 1 | 25 | 42 | 42 | 25 | 1 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

FIG. 11

| | | | | | | | | | | | | | | | | | | | |
|---|---|---|---|---|---|---|---|---|---|---|---|---|---|---|---|---|---|---|---|
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.75 | 2.85 | 2.85 | 2.85 | 2.85 | 2.75 | 2.65 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.65 | 2.50 | 2.50 | 2.50 | 2.50 | 2.50 | 2.50 | 2.50 | 2.50 | 2.50 | 2.50 | 2.50 | 2.50 | 2.50 | 2.65 | 2.50 | 2.50 |
| 2.50 | 2.50 | 2.50 | 2.50 | 2.75 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |
| 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 | 2.50 |

FIG. 12

| | | | | | | | | | | | | | | | | | | | |
|---|---|---|---|---|---|---|---|---|---|---|---|---|---|---|---|---|---|---|---|
| 2.50 | 2.50 | 2.75 | 2.85 | 2.85 | 2.90 | 2.90 | 2.90 | 2.95 | 2.95 | 2.95 | 2.95 | 2.95 | 2.90 | 2.90 | 2.85 | 2.85 | 2.75 | 2.50 | 2.50 |
| 2.50 | 2.50 | 2.50 | 2.85 | 2.90 | 2.90 | 2.90 | 2.90 | 3.15 | 3.00 | 3.00 | 3.15 | 3.00 | 2.95 | 2.90 | 2.90 | 2.85 | 2.90 | 2.50 | 2.50 |
| 2.50 | 2.75 | 2.85 | 2.90 | 2.90 | 2.95 | 3.10 | 3.00 | 2.50 | 2.75 | 2.75 | 2.90 | 3.00 | 3.10 | 2.95 | 2.90 | 2.90 | 2.85 | 2.75 | 2.50 |
| 2.50 | 2.50 | 2.85 | 2.90 | 2.95 | 3.10 | 3.00 | 2.75 | 2.85 | 2.90 | 2.90 | 2.95 | 2.75 | 3.00 | 3.10 | 2.95 | 2.90 | 2.85 | 2.50 | 2.50 |
| 2.75 | 2.85 | 2.90 | 2.95 | 2.95 | 3.00 | 2.75 | 2.90 | 2.85 | 2.85 | 2.85 | 2.85 | 2.90 | 2.75 | 3.00 | 2.95 | 2.90 | 2.90 | 2.85 | 2.75 |
| 2.75 | 2.85 | 2.90 | 2.90 | 3.10 | 2.85 | 2.90 | 2.85 | 2.85 | 2.85 | 2.85 | 2.85 | 3.05 | 2.90 | 2.85 | 3.10 | 2.95 | 2.90 | 2.85 | 2.75 |
| 2.75 | 2.85 | 2.90 | 2.95 | 3.00 | 2.75 | 2.90 | 2.95 | 2.90 | 2.90 | 2.90 | 2.90 | 2.85 | 2.85 | 2.85 | 2.75 | 3.00 | 2.95 | 2.90 | 2.75 |
| 2.85 | 2.85 | 2.90 | 3.00 | 3.00 | 2.85 | 2.85 | 2.85 | 2.90 | 2.90 | 2.90 | 2.90 | 2.85 | 2.85 | 2.85 | 3.00 | 3.00 | 2.90 | 2.85 | 2.90 |
| 2.75 | 2.85 | 2.90 | 3.00 | 3.00 | 2.90 | 2.85 | 2.85 | 2.90 | 2.90 | 2.90 | 2.90 | 2.85 | 2.85 | 2.85 | 3.00 | 3.00 | 2.90 | 2.85 | 2.75 |
| 2.75 | 2.85 | 2.90 | 2.95 | 3.00 | 2.75 | 2.90 | 2.85 | 2.90 | 2.90 | 2.90 | 2.90 | 2.85 | 2.85 | 2.75 | 3.00 | 2.95 | 2.90 | 2.85 | 2.75 |
| 2.90 | 2.90 | 2.95 | 2.90 | 3.00 | 3.00 | 2.75 | 2.90 | 2.85 | 2.85 | 2.85 | 2.85 | 2.85 | 2.75 | 3.00 | 3.00 | 2.90 | 2.95 | 2.90 | 2.90 |
| 2.90 | 2.95 | 2.85 | 2.90 | 2.95 | 2.90 | 3.00 | 2.75 | 2.90 | 2.95 | 2.90 | 2.85 | 2.75 | 3.00 | 3.00 | 2.90 | 2.95 | 2.90 | 2.95 | 2.90 |
| 2.90 | 2.90 | 2.75 | 2.85 | 2.90 | 2.95 | 3.00 | 3.00 | 2.85 | 2.75 | 2.75 | 2.85 | 3.00 | 3.00 | 2.95 | 2.90 | 2.95 | 2.75 | 2.90 | 2.90 |
| 2.90 | 2.90 | 2.90 | 2.90 | 2.85 | 2.90 | 2.90 | 2.95 | 3.00 | 3.10 | 3.10 | 3.00 | 2.95 | 2.90 | 2.90 | 2.85 | 2.85 | 2.90 | 2.90 | 2.90 |
| 2.90 | 2.90 | 2.90 | 2.90 | 2.75 | 2.85 | 2.85 | 2.90 | 2.90 | 2.90 | 2.90 | 2.90 | 2.85 | 2.85 | 2.85 | 2.75 | 2.90 | 2.90 | 2.90 | 2.90 |
| 2.90 | 2.90 | 2.90 | 2.90 | 2.90 | 2.85 | 2.90 | 2.90 | 2.85 | 2.85 | 2.85 | 2.85 | 2.85 | 2.85 | 2.85 | 2.90 | 2.90 | 2.90 | 2.90 | 2.90 |
| 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 |
| 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 | 2.90 |

FIG. 13

LIQUID-CRYSTAL RECONFIGURABLE METASURFACE REFLECTOR ANTENNA

RELATED APPLICATIONS

This application claims priority to and the benefit of United States provisional patent application No. 62/409,710 filed Oct. 18, 2016, which is incorporated herein by reference.

FIELD

The present disclosure relates to reflector antennas. In particular, the present disclosure relates to a liquid-crystal reconfigurable metasurface reflector antenna.

BACKGROUND

Next generation wireless networks are likely to rely on higher frequency, lower wavelength radio waves, including for example the use of mm-wave technologies within the 24-100 GHz frequency band. At these frequencies, larger aperture and more directive antennas are likely to be used to compensate for higher propagation losses. Common technologies for large-aperture mm-wave antennas are lens and reflector antennas. Reflector antennas have been used for various communications applications for many years. There are various types of reflector antennas, including prime-feed reflectors, offset-feed reflectors, dual-reflector antennas, etc. All these reflectors uses some form of curved metallic reflector and/or sub-reflectors to form a RF beam-collimation structure, such as the most commonly used parabolic reflectors and the Cassegrain dual-reflectors. These reflector antennas offer simplicity, low-cost and high-gain antenna performances. However, due to use of curved shaped reflector, these antennas tend to be bulky and typically can provide only a fixed beam with single feed horn.

Accordingly there is a need for a re-configurable, space-efficient reflector antenna suitable for small wavelength applications.

SUMMARY

The present description describes example embodiments of a beam steerable, flat, reflector antenna that uses a liquid-crystal-loaded metasurface reflector. The embodiments described herein may, for example, be applicable to implementation of general classes of reflector antennas, including prime-feed reflectors, offset feed reflectors, and dual-feed reflector antennas. Instead of using a curved metallic surface as in conventional reflector antennas, the embodiments described herein use an electronically tunable flat metasurface as the main reflector, whose reflective phase can be electronically reconfigured to allow effective beam forming and beam steering. Such a configuration may in some applications permit a compact, space efficient and cost effective antenna that is adapted for small wavelength, high frequency applications and that can be dynamically reconfigured.

According to one aspect there is provided a reflector antenna that includes a feed for generating a radio frequency (RF) signal, and a metasurface reflector for reflecting the RF signal originating from the feed. The metasurface reflector includes an array of cells each having a volume of liquid crystal with a controllable dielectric value enabling a reflection phase of the cells to be selectively tuned to effect beam steering of the reflected RF signal.

In one example, the antenna is a prime focus reflector with the feed generating the RF signal towards the metasurface reflector. The feed may be in-line with or offset from a center of the metasurface reflector. In another example the antenna is a dual-reflector antenna with the feed generating the RF signal towards a sub-reflector that reflects the RF signal towards the metasurface reflector.

In example embodiments the metasurface reflector includes first and second double sided substrates defining an intermediate region between them containing liquid crystal in a nematic phase. The first substrate has a first microstrip patch array formed on a side thereof that faces the second substrate, the first microstrip patch array comprising a two-dimensional array of microstrip patches each being electrically connected to a common potential. The second substrate has a second microstrip patch array formed on a side thereof that faces the first substrate, the second microstrip patch array comprising a two-dimensional array of microstrip patches each having a respective conductive terminal. The first microstrip patch array and the second microstrip patch array are aligned to form the array of cells, each cell comprising a microstrip patch of the first microstrip patch array arranged in spaced apart opposition to a microstrip patch of the second microstrip patch array with the volume of the liquid crystal located therebetween. The conductive terminal to the microstrip patch of the second microstrip patch array permits a control voltage to be applied to the cell to control the dielectric value of the volume of the liquid crystal, thereby permitting the reflection phase of the cell to be selectively tuned.

In some examples, the metasurface reflector includes a gridded wire mesh on the first substrate, each of the microstrip patches of the first microstrip patch array being electrically connected to a respective point of the gridded wire mesh to provide the common potential. In some examples, the first and second double sided substrates are formed from planar printed circuit boards.

According to another aspect, there is provided a method of beam steering that includes: generating an RF signal at a feed for application to a metasurface reflector comprising a two dimensional array of cells each including a volume of liquid crystal; reflecting the applied RF signal off of the metasurface reflector; and adjusting voltages to control terminals associated with a plurality of the cells of the metasurface to adjust a phase of the reflected RF signal by adjusting an orientation of the molecules of the liquid crystal within each cell. In some examples, the feed generates the RF signal towards the metasurface reflector. In some examples, the feed generates the RF signal towards a sub-reflector that directs the RF signal towards the metasurface reflector.

According to a further example aspect is a reflector antenna that includes a reconfigurable metasurface reflector for reflecting RF signals, the metasurface reflector comprising an array of cells each having a tunable reflection phase. The antenna also includes a controller configured to apply control signals to the array of cells to tune the reflection phase of the cells to selectively beam steer RF signals reflected from the metasurface reflector, and a feed structure for at least one of: feeding RF signals to the metasurface reflector; and receiving RF signals reflected from the metasurface reflector. In example configurations, the cells each have a volume of liquid crystal with a dielectric value that is controllable by the control signals.

BRIEF DESCRIPTION OF THE DRAWINGS

Reference will now be made, by way of example, to the accompanying drawings which show example embodiments of the present application, and in which:

FIG. 10 shows a simulation of typical phase distribution of the dual-reflector metasurface antenna of FIG. 8 (tilt=0 deg);

FIG. 11 shows a simulation of typical phase distribution of the dual-reflector metasurface antenna of FIG. 8 (tilt=15 deg);

FIG. 12 shows a simulation of the effective dielectric constant distribution of the dual-reflector metasurface antenna of FIG. 8 (tilt=0 deg);

FIG. 13 shows a simulation of the effective dielectric constant distribution of the dual-reflector metasurface antenna of FIG. 8 (tilt=15 deg);

Similar reference numerals may have been used in different figures to denote similar components.

DESCRIPTION OF EXAMPLE EMBODIMENTS

Figure 1:
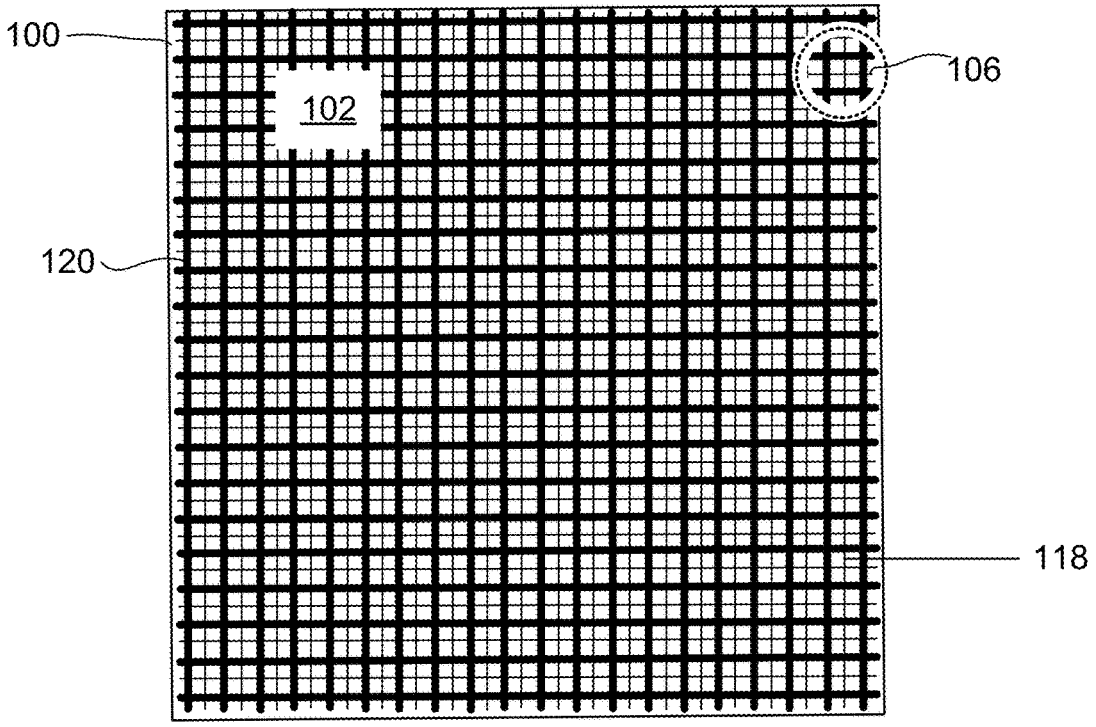
FIG. 1 is a top plan view of a liquid crystal tunable metasurface reflector.
Figure 2:
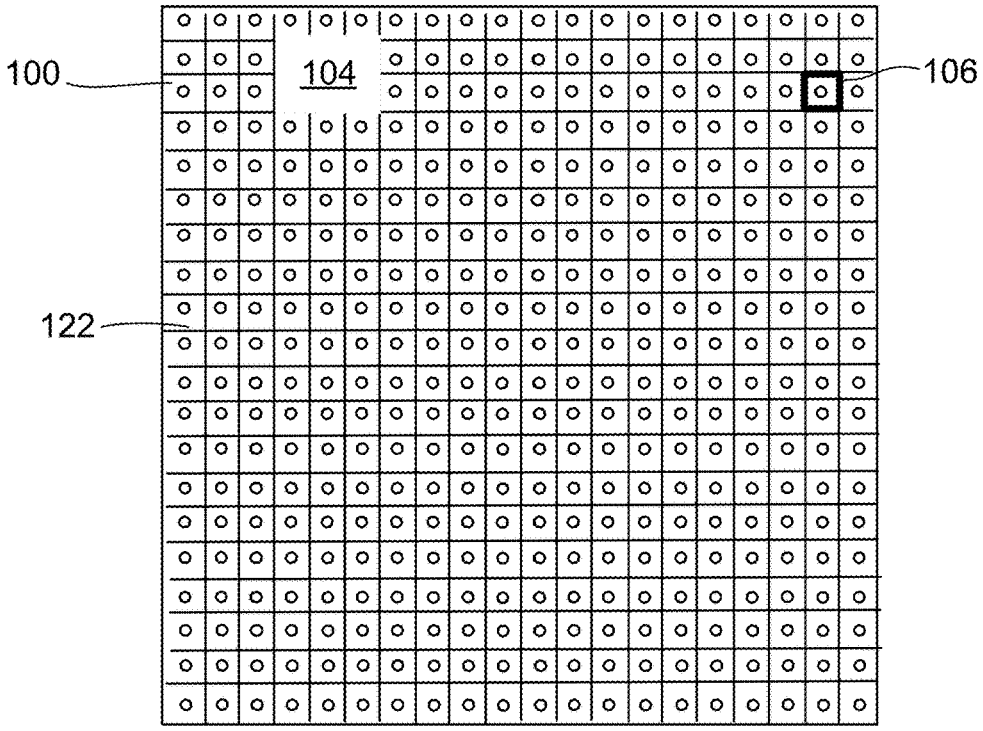
FIG. 2 is a bottom plan view of the liquid crystal tunable metasurface reflector of FIG. 1.

Example embodiments are described below that incorporate metasurface technology, and in particular a metasurface that is a two-dimensional periodical structure that contains electrically small scatterers with periodicity relatively small compared to the operating wavelength. A metasurface can be used to provide tailored reflection and transmission characteristics of EM waves using fixed patterned metallic structure. As described in U.S. Provisional Patent Application No. 62/398,141 filed Oct. 5, 2016, (incorporated herein by reference), a reconfigurable metasurface can be achieved by loading a metasurface with nematic liquid crystal. The metasurface makes use of the tunable dielectric anisotropy of liquid crystals to realize phase-tunable flat metasurface reflectors. By varying DC voltages on microstrip patches of unit cells, effective dielectric constant, and therefore the phase differential at various locations of the metasurface can be changed as desire. This concept combines features of metasurface with the unique properties of electronically tunable liquid crystal to enable real-time reconfiguration of metasurface to achieve beam steerable, flat, reflector antennas.

The present description describes example embodiments of a beam steerable, flat, reflector antenna that uses a liquid-crystal-loaded metasurface. The embodiments described herein may, for example, be applicable to implementation of general classes of reflector antennas, including prime-feed reflectors, offset feed reflectors, and dual-feed reflector antennas. Instead of using a curved metallic surface as in conventional reflector antennas, the embodiments described herein use an electronically tunable flat metasurface as the main reflector, whose reflective phase can be electronically reconfigured to allow effective beam forming and beam steering. In example embodiments, the flat metasurface is loaded with liquid crystal, embedded between two microstrip patch array layers, which form an array of individually controllable cells. An effective dielectric constant between the two microstrip patch layers at each unit cell can be tuned individually by varying electrostatic field between the patches due to the anisotropy of the liquid crystal. Therefore, the resonant frequency of each unit cell can be tuned individually and electronically by adjusting DC voltage at each cell. Because reflection phase is determined by the frequency of the incoming wave with respect to the resonance frequency, such surface can be tuned to form a distributed 2D phase shifter. Therefore, an incoming wave can be redirected by adjusting DC voltages of unit cells of the metasurface to give proper phase distribution for the desired direction of reflected wave.

In this regard, example embodiments of an electronically tunable metasurface reflector 100 that can be used to implement a reflective antenna is shown in FIGS. 1 to 5. The metasurface reflector 100 is a liquid-crystal-loaded tunable sheet providing a reflective phase that can be electronically reconfigured to allow effective antenna beam steering. The metasurface reflector 100 is a high-impedance surface and includes an upper surface or side 102 (shown in FIG. 1), a bottom surface or side 104 (shown in FIG. 2), and includes an array of addressable cells 106 for reflective beam steering antenna applications. In an example embodiment, the cells 106 are arranged to provide a two-dimensional periodical structure implementing an array of electrically small scatterers. The dimensions of the cells 106 are selected such that the periodicity of the cell array is relatively small compared to the operating wavelength of the radio waves that the metasurface reflector 100 is intended to reflect. In some examples, the cells have a periodicity that is less than a quarter of the minimum intended operating wavelength.

Figure 3:
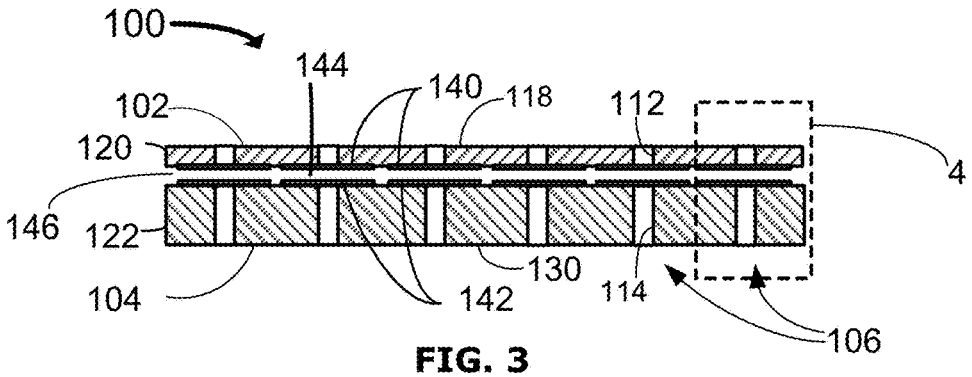
FIG. 3 is a side cross-section view of the liquid crystal tunable metasurface reflector of FIG. 1.
Figure 4:
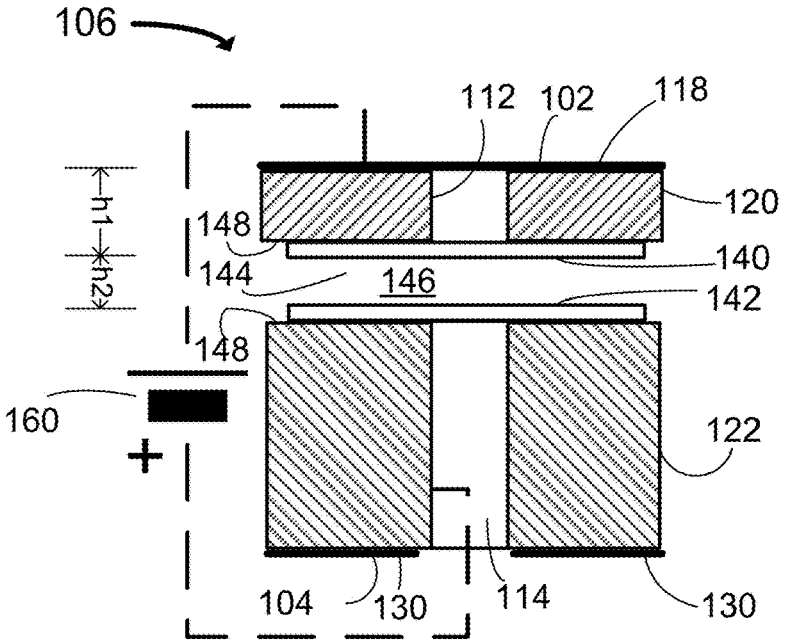
FIG. 4 is a side cross-section view of a unit cell of the liquid crystal tunable metasurface reflector of FIG. 4.

A physical implementation of metasurface reflector 100 will now be described according to example embodiments. FIG. 3 illustrates a side sectional view of a row of cells 106 of metasurface reflector 100, and FIG. 4 shows an enlarged side sectional view of one of the cells 106 as indicated by dashed box 4 in FIG. 3. In the illustrated embodiment, the metasurface reflector 100 includes an upper multi-layer double-sided printed circuit board (PCB) 120 and a lower multi-layer double sided PCB 122, which respectively define the upper and bottom sides 102, 104. A sub-operating wavelength layer of electronically tunable liquid crystal (LC) 146 is located between the upper and lower PCBs 120,122.

Figure 5:
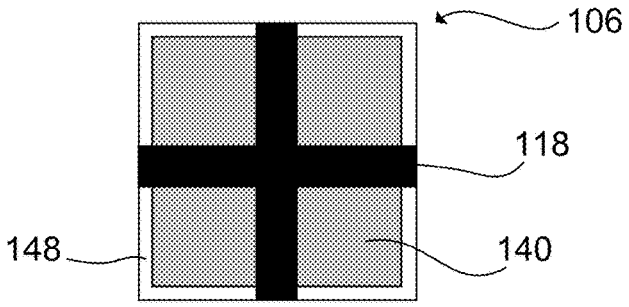
FIG. 5 is a top plan view of selected elements of a unit cell of the liquid crystal tunable metasurface reflector of FIG. 1.

Upper PCB 120 has a central non-conductive substrate layer (shown in cross-hatch in FIGS. 3 and 4). A gridded wire mesh 118 forms the top layer of the PCB 120, and a two dimensional array of conductive microstrip patches 140, each of which is surrounded by an insulating slot or gap 148, forms the bottom layer of the PCB 120. In the illustrated embodiment each microstrip patch 140 is electrically connected by a conductive plated-through hole (PTH) via 112 that extends from the center of the patch 140 through the PCB 120 substrate layer to a respective intersection point of wire mesh 118 such that wire mesh 118 provides a common DC return path for each of the microstrip patches 140. FIG. 5 shows a top view of the wire mesh 118 and microstrip patch 140 layers of a single cell 106 (the substrate layer of PCB 120 is not shown in FIG. 5). In example embodiments, PTH vias 112 may be provided by forming and plating holes through the PCB 120 substrate layer, microstrip patches 140 may be formed from etching gaps 148 from a conductive layer on the lower surface of PCB 120, and gridded wire mesh 118 may be similarly formed by etching a conductive layer on the upper layer of PCB 120.

Lower PCB 122 has a central non-conductive substrate layer (shown in cross-hatch in FIGS. 3 and 4). A two dimensional array of conductive microstrip patches 142, which are each surrounded by an insulating slot or gap 148 and correspond in shape and periodicity to the upper PCB microstrip patches 140, form the top layer of lower PCB 122, and a conductive ground plane 130 forms the bottom layer of PCB 122. Each microstrip patch 142 is electrically connected to a respective conductive plated-through hole (PTH) via 114 that extends from the center of the patch 142 through the PCB 122 substrate layer to the ground plane 130 layer. The ground plane 130 includes an array of openings on the substrate layer that form a circular gap between the ground plane and the PTH vias 114 such that the ground plane 130 is electrically isolated from each of the PTH vias 114, permitting a unique control voltage to be applied to each PTH via 114. In example embodiments, PTH vias 114 may be provided by forming and plating holes through the PCB 122 substrate layer, microstrip patches 142 may be formed from etching gaps 148 from a conductive layer on the upper surface of PCB 120, and ground plane 130 may be similarly formed by etching a conductive layer on the lower layer of PCB 120 to provide insulated openings around each of the PTH vias 114.

In the example embodiment described above, control voltages are provided to the lower microstrip patches 142 through PTH vias 114 that are accessible through the ground plane 130. Other embodiments could have different configurations, including a control line layer that could be integrated into substrate 122 to provide conductive control terminals to each of the microstrip patches 142.

As described above, the upper and lower PCBs 120, 122 are located in spaced opposition to each other with an intermediate layer of liquid crystal 146 located between them. The upper PCB microstrip patches 140 and the lower PCB microstrip patches 142 align with each other to from an array of cell regions 144, each of which contains a volume of liquid crystal 146, thus providing an array of individually controllable, LC cell regions 144.

Accordingly, as can be appreciated from FIG. 4, each unit cell 106 includes a volume of tunable liquid crystal 146 that is located in region 144 between an upper conductive microstrip patch 140 and a lower conductive microstrip patch 142. Upper conductive microstrip patch 140 is connected by a respective conductive path (PTH via 112) to a common potential, namely wire mesh 118, and lower conductive microstrip patch 142 is connected to a control terminal (PTH via 114) that allows a unique control voltage from an adjustable DC voltage source 160 to be applied to the microstrip patch 142

The metasurface reflector 100 has a resonant frequency that can depend on the geometry of the cells 106 and dielectric properties of the materials used in the PCBs 120, 122. In a example embodiments, the microstrip patches 140, 142 have rectangular surfaces (for example square) having a maximum normal dimension that is less than ¼ of the minimum intended operating wavelength, however other microstrip patch configurations could be used. In example embodiments, the microstrip patches 140, 142 may have dimensions that are less than quarter of a wavelength of the intended operating wavelength of the metasurface reflector 100. In an example embodiment, wire mesh 118 has a periodicity and grid dimensions that correspond to those of microstrip patches 140, with a grid intersection point occurring over a center point of each microstrip patch 140.

As noted above, in at least some examples, the metasurface reflector 100 illustrated in FIGS. 1 to 5 provides a structure in which etching can be used to form the components of PCB boards 120, 122. During assembly, liquid crystal 146 is can be placed between the PCB's 120, 122, which can then be secured together.

In example embodiments, the liquid crystal 146 is a nematic liquid crystal that has an intermediate nematic gel-like state between solid crystalline and liquid phase at the intended operating temperature range of the metasurface reflector 100. Examples of liquid crystal include, for example, GT3-23001 liquid crystal and BL038 liquid crystal from the Merck group. Liquid crystal 146 in a nematic state possesses dielectric anisotropy characteristics at microwave frequencies, whose effective dielectric constant may be adjusted by setting different orientations of the molecules of liquid crystal 146 relative to its reference axis.

At microwave frequencies, the liquid crystal 146 may change its dielectric properties due to different orientations of the molecules 602 caused by application of electrostatic field between the microstrip patches 140 and 142. Thus, the dielectric constant between the microstrip patches 140 and 142 at each unit cell 106 can be tuned by varying the DC voltage applied to patch 142, allowing the reflection phase at each individual unit cell 106 to be controlled. The unit cells 106 can be collectively controlled so that metasurface reflector 100 acts like a distributed spatial phase shifter that interacts with an incident wave and produces a reflected wave with varying phase shift across its aperture. Because reflection phase is determined by the frequency of the incoming wave with respect to the resonance frequency, the metasurface reflector 100 can be tuned to form a distributed 2D phase shifter. Therefore, an incoming wave may be redirected by adjusting DC voltages of unit cells 106 to give proper phase distribution for the desired direction of reflected wave.

In example embodiments the metasurface reflector 100 has a relatively high density/small periodicity of cells 106. In an example embodiment, where $\lambda$ represents an minimum intended operating frequency, top PCB 120 is relatively thin, having a thickness $h1<\lambda/20$ and the liquid crystal 146 in cell region 144 has a thickness of $h2<\lambda/20$ (i.e. the gap between the opposed microstrip patches 140 and 142). The thicknesses h1 and h2 can be different from each other. In example embodiments the bottom PCB 122 has a finite thickness $h3<\lambda/4$.

It will thus be appreciated that the reflection phase of an incident wave at the surface of the metasurface reflector 100 can be controlled by varying the DC voltages applied to unit cells 106 such that continuous beam steering of an EM wave can be achieved by regulating DC voltage distribution to unit cells 106 across the metasurface reflector 100.

Example embodiments of LC reconfigurable metasurface reflector antennas will now be described. Although the reflector antenna embodiments described below incorporate LC reconfigurable metasurface reflector 100, it is possible that other LC reconfigurable metasurface configurations could also be suitable for use as a reflector in the antennas described below.

Figure 6:
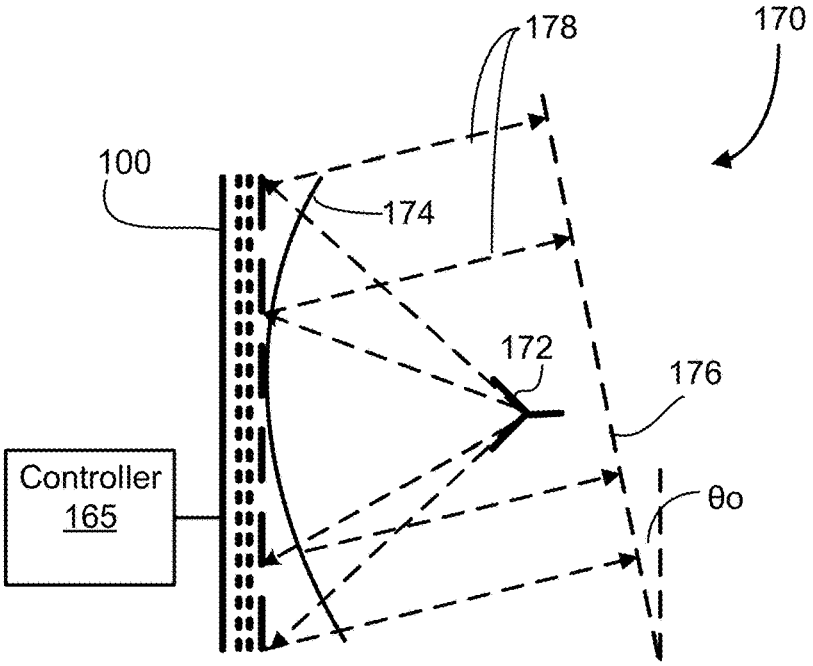
FIG. 6 is a schematic illustration of a prime-focus beam-steerable metasurface reflector antenna, where a feed structure is placed in the front center of a metasurface reflector, according to example embodiments.
Figure 7:
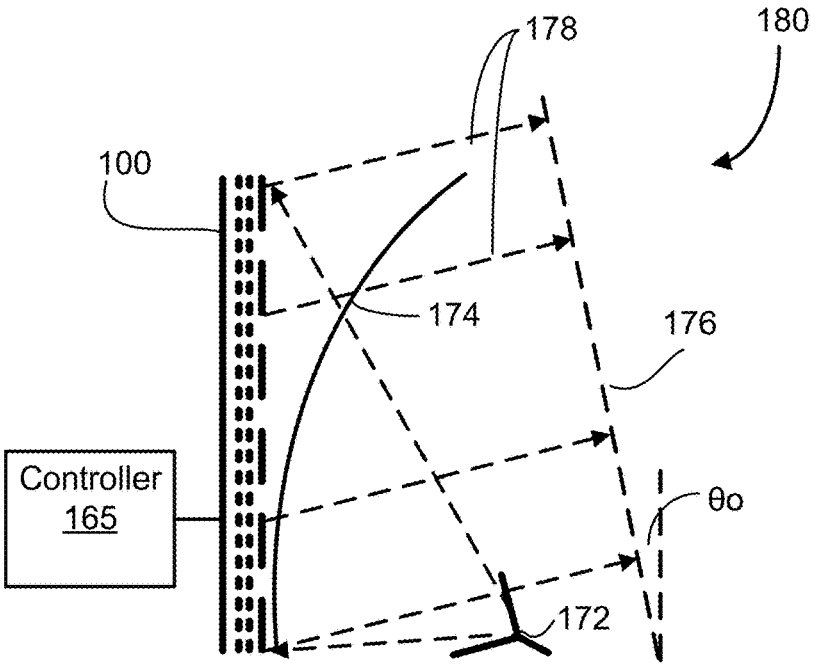
FIG. 7 is a schematic illustration of an offset feed beam-steerable metasurface reflector antenna, where a single feed is placed at an offset location from the front center of a metasurface reflector, according to example embodiments.
Figure 8:
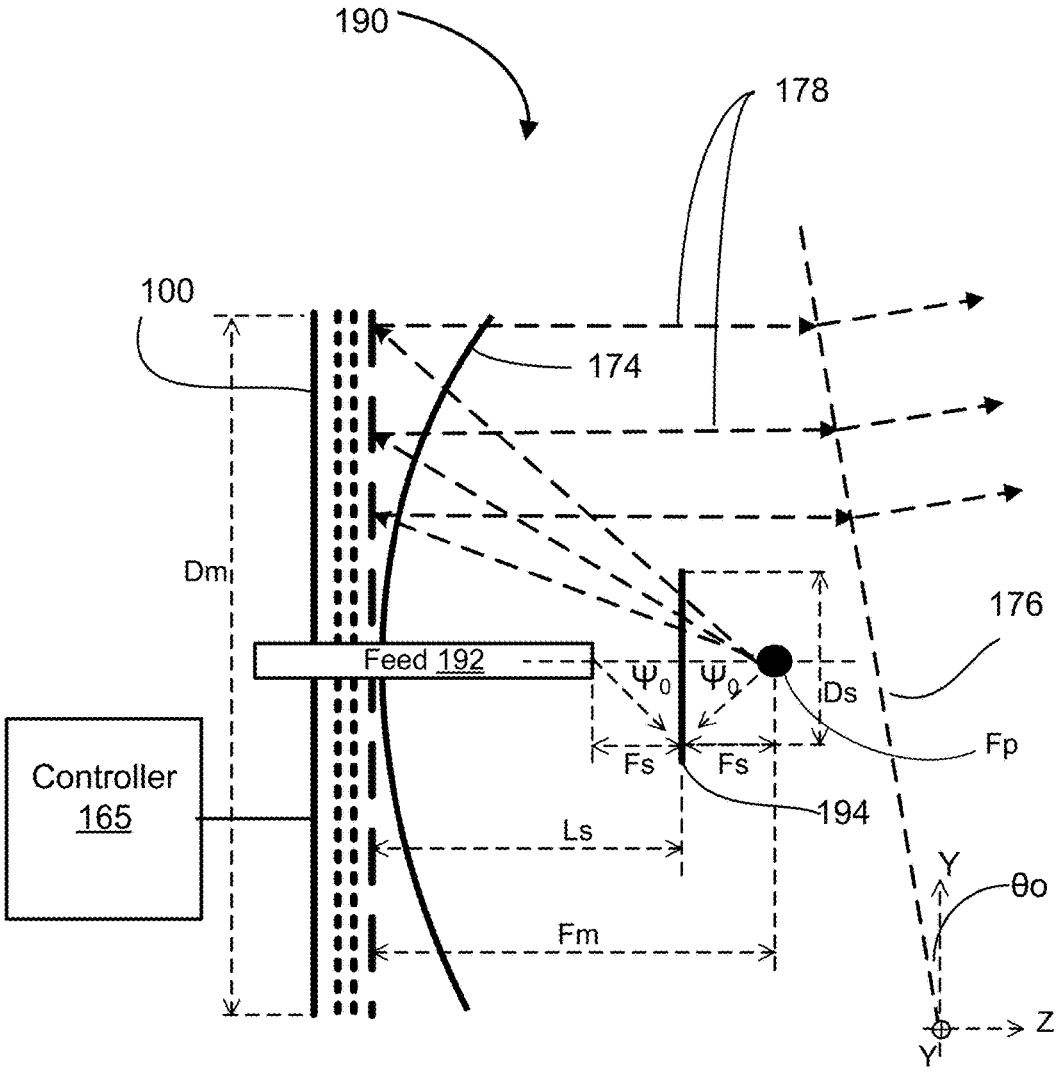
FIG. 8 is a schematic illustration of a dual-reflector metasurface reflector antenna where a flat sub-reflector is placed in the front center of a metasurface reflector, according to example embodiments.

As with parabolic reflectors, many types of feed configurations can be used with flat metasurface reflectors. FIGS. 6-8 show some possible antenna configurations for beam-steerable metasurface reflector antennas, according to example embodiments. FIG. 6 illustrates prime-focus beam-steerable metasurface antenna 170, where a feed structure 172 for generating an RF signal is placed in the front center of a metasurface reflector 100. FIG. 7 shows an offset feed beam steerable metasurface reflector antenna 180, where a single RF feed structure 172 is placed at an offset location from the front center of a metasurface reflector 100. FIG. 8 shows a dual-reflector metasurface antenna 190 with a central RF feed structure 192, where a flat sub-reflector 194 is placed in the front center of a metasurface reflector 100.

In each of the configurations of FIGS. 6, 7 and 8, liquid-crystal-loaded flat metasurface reflector 100 is used to provide the necessary parabolic phase distribution (represented by parabola 174) across the surface of the metasurface reflector, including phase offset required for beam collimation and possible beam tilt, θo, required to provide the reflected wave-front represented by line 176. The required phase distribution on the metasurface reflector can be computed using path delay of wave propagation between the feed structure 172, 192 and the metasurface reflector 100. In example embodiments, a controller 165 is configured to control the DC voltage applied across each of the unit cells 106 in the metasurface reflector 100 to achieve the required phase distribution.

Referring to FIG. 8, the example of prime-feed metasurface reflector antenna 190 will be described in greater detail, however it will be noted that the general geometrical parameters discussed below in respect of the dual reflector antenna of FIG. 8 are also applicable to the single reflector antennas of FIGS. 6 and 7. In single prime-feed case of FIG. 6, the feed structure 172 is placed at the focal point of the metasurface reflector 100. In the case of FIG. 8 where a dual-reflector is used, a flat metallic sub-reflector 194 is used and the metasurface reflector 100 is designed to have phase distribution 174 such that its focus point $F_p$ falls at the mirror image of the phase center of the sub-reflector structure 194. Referring to FIG. 8, geometrical parameters of the metasurface reflector 100 can be calculated using the following relationships:

$$\varphi o = \tan^{-1}\left(\frac{D_m}{2 * F_m}\right)$$

$$\frac{D_m}{F_m} = \frac{D_s}{F_s}$$

$$L_s = F_m - F_s$$

Where:

$D_m$=minimum dimension of the reflecting surface of metasurface reflector 100 (e.g. the lesser of width or length in the case of a rectangular metasurface reflector, radius in case of circular reflector);

$D_s$=minimum dimension of the reflecting surface of metasurface flat sub-reflector 194 (e.g. the lesser of width or length in the case of a rectangular metasurface reflector, radius in case of circular reflector);

$F_s$=distance of flat sub-reflector 194 from end of feed structure 192=distance of flat sub-reflector 194 from focal point $F_p$;

$F_m$=focal length (normal distance of focal point $F_p$ from reflecting surface of metasurface reflector 100)

Based on the dimension of the metasurface reflector (Dm) and its focal length (Fm), along with the required beam tilt angle (θo), an initial phase distribution $\phi(x_i,y_i)$ (where $x_i$, $y_i$ represent a cell location in the metasurface reflector) for the cell units 106 of the metasurface reflector 100 can be calculated by controller 165 using the path delay:

$$\phi(x_i, y_i) = \frac{2\pi}{\lambda_0} * \left[\sqrt{F_m^2 + \left(\frac{D_m}{2}\right)^2} - r_i + x_i * \tan(\theta_0)\right]$$

$$\text{Where } r_i = \sqrt{x_i^2 + y_i^2 + F_m^2}$$

Controller 165 can apply DC voltages to unit cells 106 required to achieve the calculated phase distribution. In examples, the calculations can be ongoing to provide adaptive phase compensation across the metasurface reflector 100, allowing the reflector to be continuously shaped for optimum amplitude taper to give optimum beam performance. In example embodiments, controller 265 comprises a processor and an associated digital storage that stores instructions and data for the processor to enable the beam steering functionality described herein. In some examples, controller 265 may comprise a programmable logic controller.

In example embodiments the metasurface reflector antennas 170, 180, and 190 can be operated to both transmit and receive RF signals. In the case of RF signal transmission, the RF feed structure 172, 192 converts electric currents from a transmitter circuit into wireless RF waves that are reflected by the metasurface reflector 100, and in the case of RF signal reception, the RF feed structure 172, 192 converts RF waves reflected by the metasurface reflector 100 into electric currents for a receiver circuit. In some examples the metasurface reflector antennas 170, 180, and 190 may be used as transmit-only or receive-only antennas.

Figure 9:
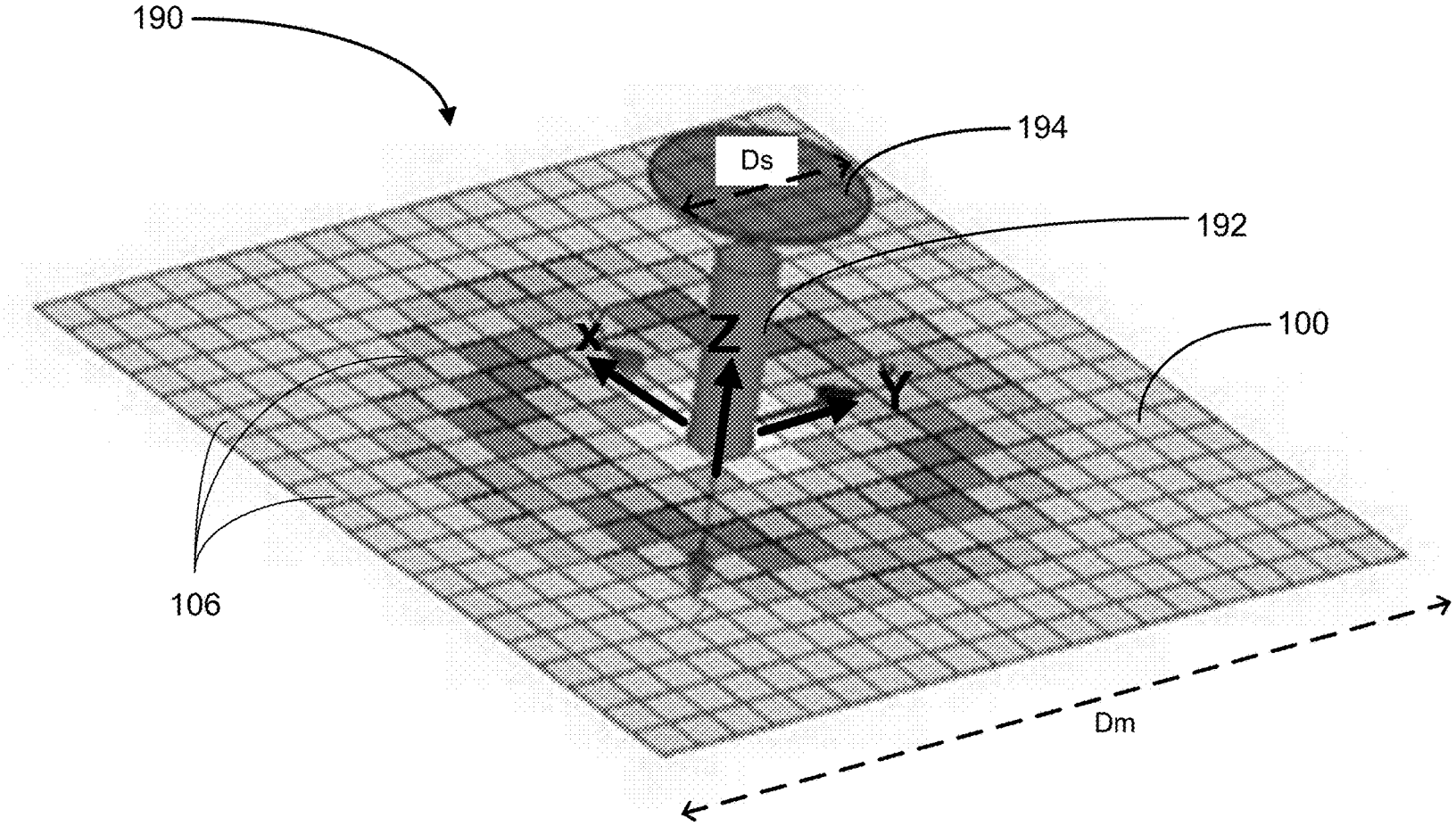
FIG. 9 is a schematic perspective view of an simulation of the dual-reflector metasurface reflector antenna of FIG. 8, showing typical phase distribution on dual-reflector metasurface (tilt=0 deg)
Figure 14:
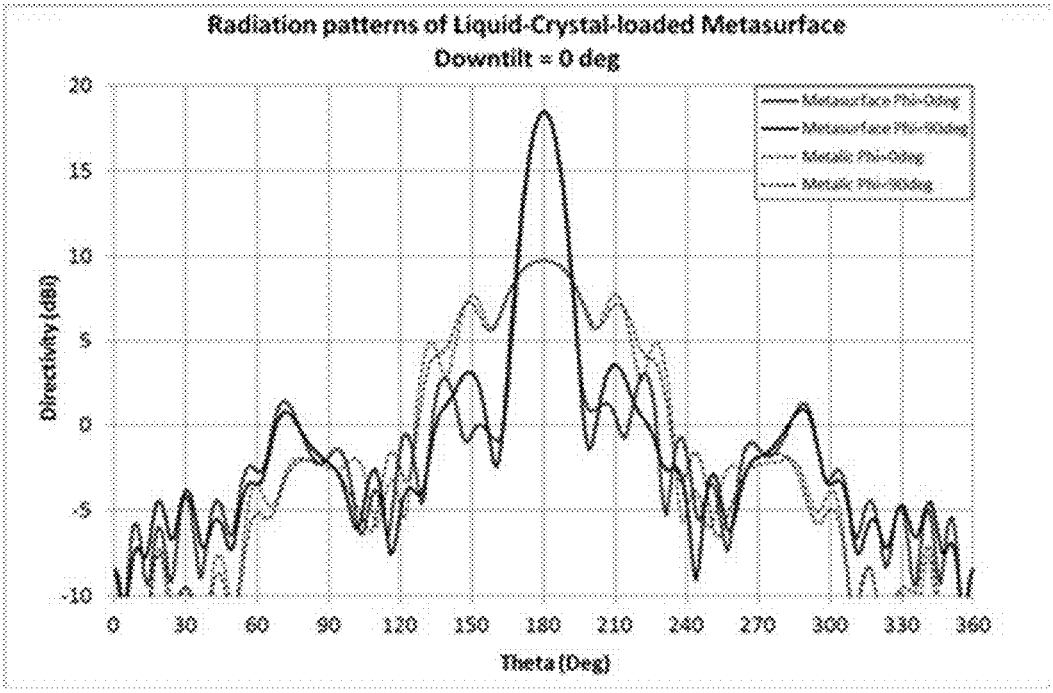
FIG. 14 shows a simulation of the radiation pattern of the example dual-reflector metasurface antenna of FIG. 8 (tilt=0 deg)
Figure 15:
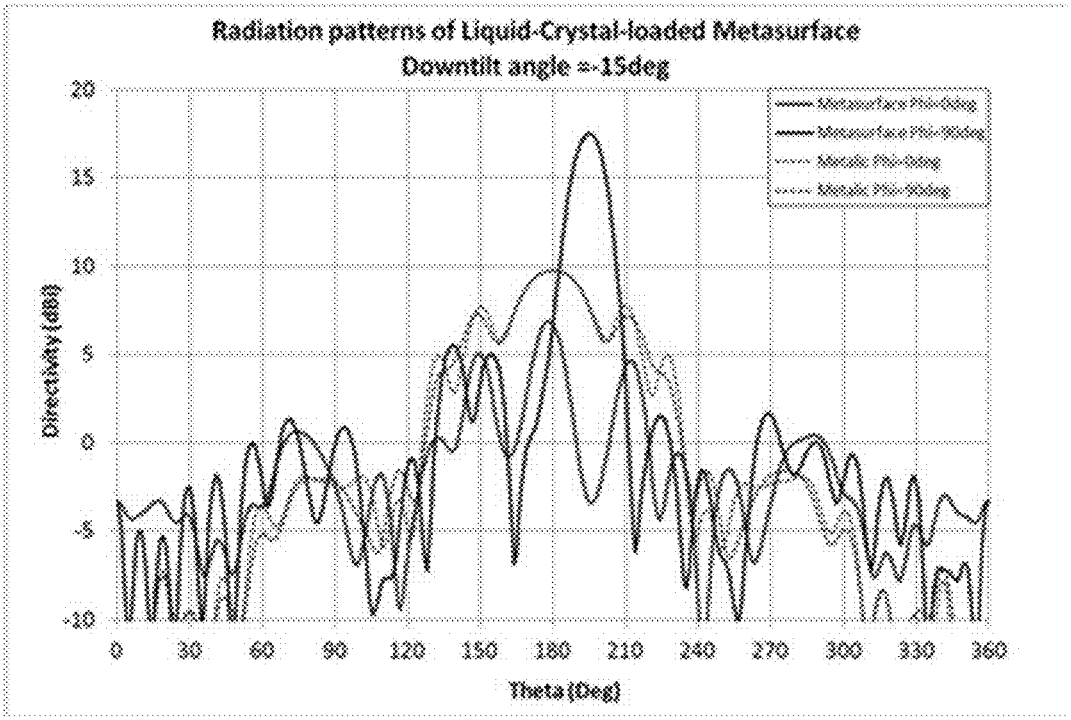
FIG. 15 shows a simulation of the radiation pattern of the example dual-reflector metasurface antenna of FIG. 8 (tilt=15 deg)

By way of example, FIG. 9 shows an example of a dual-reflector antenna 190 using a flat sub-reflector liquid-crystal-loaded metasurface reflector 100. This example is simulated using a full-wave finite element EM simulator, HFSS. The dimension of the metasurface is Dm=88 mm with focal length of Fm=30 mm. The sub-reflector 194 dimension is 20 mm with Ls=23.2 mm. FIGS. 10 and 11 show simulated reflection phase distribution across the cells 106 on the metasurface reflector 100 for 0 deg and 15 deg tilt angle cases. FIGS. 12 and 13 give simulated effective dielectric constant distributions of liquid crystal in the cells 106 of metasurface reflector 100 for tilt angle 0 deg and 15 deg. FIGS. 14 and 15 gives simulated radiation patterns of the dual-reflector metasurface antenna 190.

Figure 16:
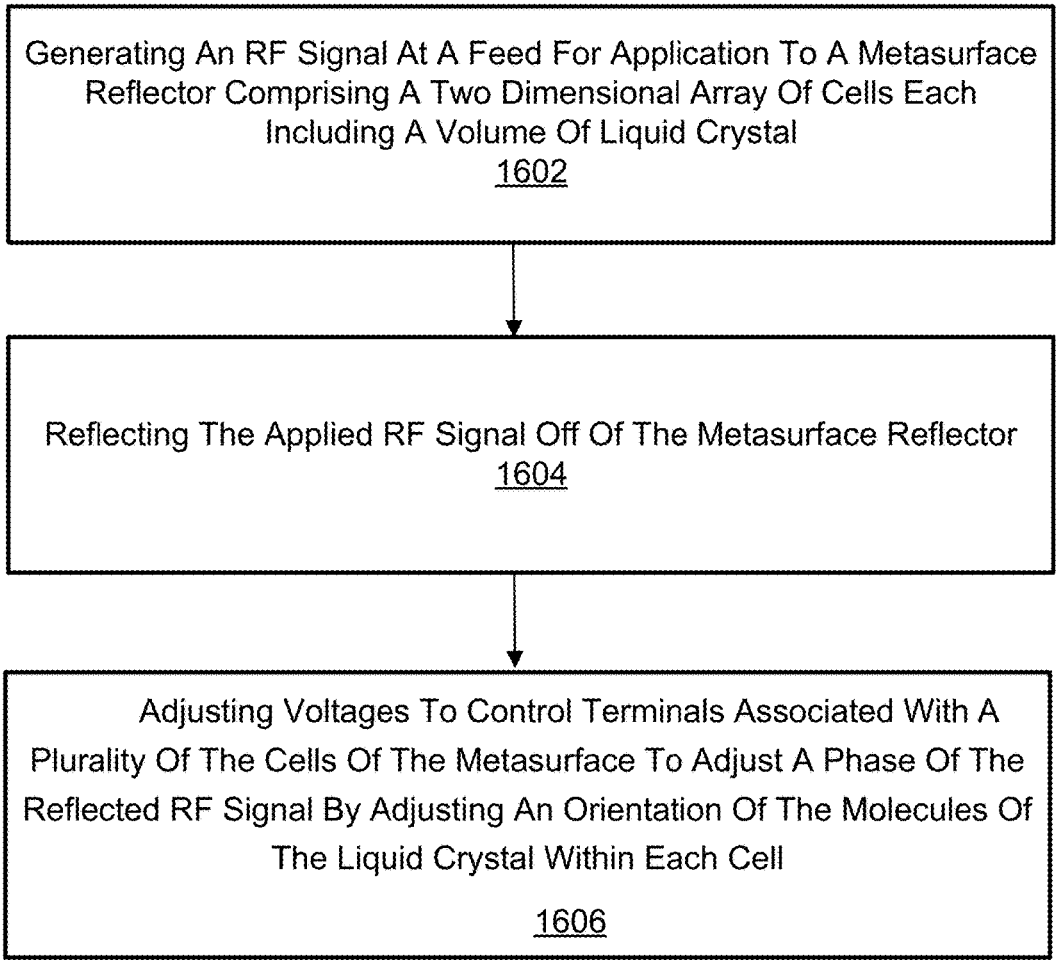
FIG. 16 is a flow diagram of a method of beam steering according to example embodiments.

FIG. 16 shows an method of beam steering that can be carried out using a reflector antenna such as antenna 170, 180 or 190 according to example embodiments. As indicated at step 1602, the method includes generating an RF signal at a feed (for example feed structure 172 or 192) for application to a metasurface reflector 100 comprising a two dimensional array of cells 106 each including a volume of liquid crystal 146. The method also includes reflecting the applied RF signal off of the metasurface reflector 100 (step 1604) and adjusting voltages to control terminals 114 associated with a plurality of the cells of the metasurface to adjust a phase of the reflected RF signal by adjusting an orientation of the molecules of the liquid crystal within each cell (step 1606).

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure. For examples, although specific sizes and shapes of cells 106 are disclosed herein, other sizes and shapes may be used.

Although the example embodiments disclose individually addressable cells, other embodiments may have cells that may be addressable by row or column or in a multiplexed manner.

Although the example embodiments are described with reference to a particular orientation (e.g. upper and lower), this was simply used as a matter of convenience and ease of understanding in describing the reference Figs. The metasurface may have any arbitrary orientation.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. A reflector antenna, comprising:

a feed for generating a radio frequency (RF) signal; and a metasurface reflector for reflecting the RF signal originating from the feed, the metasurface reflector comprising an array of cells each having a volume of liquid crystal with a controllable dielectric value enabling a reflection phase of the cells to be selectively tuned to effect beam steering of the reflected RF signal, the metasurface reflector comprising first and second double sided substrates defining an intermediate region between them containing liquid crystal in a nematic phase;

the first double sided substrate having a first microstrip patch array formed on a side thereof that faces the second substrate, the first microstrip patch array comprising a two-dimensional array of microstrip patches each being electrically connected to a common potential; and the second double sided substrate having a second microstrip patch array formed on a side thereof that faces the first substrate, the second microstrip patch array comprising a two-dimensional array of microstrip patches each having a respective conductive terminal;

the first microstrip patch array and the second microstrip patch array being aligned to form the array of cells; and the metasurface reflector comprising a gridded wire mesh on the first substrate, each of the microstrip patches of the first microstrip patch array being electrically connected to a respective point of the gridded wire mesh to provide the common potential.

2. The reflector antenna of claim 1 wherein the antenna is a prime focus reflector antenna with the feed generating the RF signal towards the metasurface reflector.

3. The reflector antenna of claim 2 wherein the feed is offset from a center of the metasurface reflector.

4. The reflector antenna of claim 1 wherein the antenna is a dual-reflector antenna with the feed generating the RF signal towards a sub-reflector that reflects the RF signal towards the metasurface reflector.

5. The reflector antenna of claim 1 wherein each cell comprising a microstrip patch of the first microstrip patch array is arranged in spaced apart opposition to a microstrip patch of the second microstrip patch array with the volume of the liquid crystal located therebetween, the conductive terminal to the microstrip patch of the second microstrip patch array permitting a control voltage to be applied to the cell to control the dielectric value of the volume of the liquid crystal, thereby permitting the reflection phase of the cell to be selectively tuned.

6. The reflector antenna of claim 5 wherein the first and second double sided substrates are formed from planar printed circuit boards.

7. The reflector antenna of claim 5 wherein a thickness of the first substrate and a thickness of the intermediate region containing the liquid crystal are each less than 1/20 of an intended minimum operating wavelength of the incident wave.

8. The reflector antenna of claim 5 wherein a periodicity of the cells is less than 1/4 of an intended minimum operating wavelength of the incident wave.

9. The reflector antenna of claim 1 wherein the gridded wire mesh is formed on a side of the first substrate that is opposite the side on which the first microstrip patch array is formed, each of the microstrip patches of the first microstrip patch array being electrically connected to the gridded wire mesh by a respective plated through hole that extends through the first substrate.

10. The reflector antenna of claim 1 comprising a controller operatively connected to the metasurface reflector for selectively tuning the reflection phase of the cells.

11. A method of beam steering, comprising:

generating an RF signal at a feed for application to a metasurface reflector comprising a two dimensional array of cells each including a volume of liquid crystal;

reflecting the applied RF signal off of the metasurface reflector; and adjusting voltages to control terminals associated with a plurality of the cells of the metasurface to adjust a phase of the reflected RF signal by adjusting an orientation of the molecules of the liquid crystal within each cell, the metasurface reflector comprising first and second double sided substrates defining an intermediate region between them containing liquid crystal in a nematic phase;

the first double sided substrate having a first microstrip patch array formed on a side thereof that faces the second substrate, the first microstrip patch array comprising a two-dimensional array of microstrip patches each being electrically connected to a common potential; and the second double sided substrate having a second microstrip patch array formed on a side thereof that faces the first substrate, the second microstrip patch array comprising a two-dimensional array of microstrip patches each having a respective conductive terminal;

the first microstrip patch array and the second microstrip patch array being aligned to form the array of cells; and the metasurface reflector comprising a gridded wire mesh on the first substrate, each of the microstrip patches of the first microstrip patch array being electrically connected to a respective point of the gridded wire mesh to provide the common potential.

12. The method of claim 11 wherein the feed generates the RF signal directly towards the metasurface reflector.

13. The method of claim 11 wherein the feed generates the RF signal towards a sub-reflector that directs the RF signal towards the metasurface reflector.

14. A reflector antenna, comprising:

a reconfigurable metasurface reflector for reflecting RF signals, the metasurface reflector comprising an array of cells each having a tunable reflection phase;

a controller configured to apply control signals to the array of cells to tune the reflection phase of the cells to selectively beam steer RF signals reflected from the metasurface reflector; and a feed structure for at least one of: feeding RF signals to the metasurface reflector; and receiving RF signals reflected from the metasurface reflector, the metasurface reflector comprising first and second double sided substrates defining an intermediate region between them containing liquid crystal in a nematic phase;

the first double sided substrate having a first microstrip patch array formed on a side thereof that faces the second substrate, the first microstrip patch array comprising a two-dimensional array of microstrip patches each being electrically connected to a common potential; and the second double sided substrate having a second microstrip patch array formed on a side thereof that faces the first substrate, the second microstrip patch array comprising a two-dimensional array of microstrip patches each having a respective conductive terminal;

the first microstrip patch array and the second microstrip patch array being aligned to form the array of cells; and the metasurface reflector comprising a gridded wire mesh on the first substrate, each of the microstrip patches of the first microstrip patch array being electrically connected to a respective point of the gridded wire mesh to provide the common potential.

15. The reflector antenna of claim 14 wherein the cells each have a volume of liquid crystal with a dielectric value that is controllable by the control signals.

16. The reflector antenna of claim 15 wherein the antenna is a prime focus reflector antenna with the feed structure being located to feed RF signals directly towards or receive RF signals directly from the metasurface reflector.

17. The reflector antenna of claim 16 wherein the feed structure is offset from a center of the metasurface reflector.

18. The reflector antenna of claim 15 wherein the antenna is a dual-reflector antenna with the feed generating the RF signal towards a sub-reflector that reflects the RF signal towards the metasurface reflector.

19. The reflector antenna of claim 15 wherein each cell comprising a microstrip patch of the first microstrip patch array is arranged in spaced apart opposition to a microstrip patch of the second microstrip patch array with the volume of the liquid crystal located therebetween, the conductive terminal to the microstrip patch of the second microstrip patch array permitting a control voltage from the controller to be applied to the cell to control the dielectric value of the volume of the liquid crystal.

* * * * *